US005802419A

United States Patent [19]

Sakurai et al.

[11] Patent Number: 5,802,419

[45] Date of Patent: Sep. 1, 1998

[54] IMAGE FORMING APPARATUS AND PROCESS CARTRIDGE FOR IMAGE FORMING APPARATUS

[75] Inventors: Kazushige Sakurai, Gotenba; Hiroshi Sato, Suntoh-gun; Kazumi Yamauchi, Numazu, all of Japan

[73] Assignee: Canon Kabushiki Kaisha, Tokyo, Japan

[21] Appl. No.: 731,054

[22] Filed: Oct. 9, 1996

[30] Foreign Application Priority Data

Oct. 9, 1995 [JP] Japan ..... 7-288079

[51] Int. Cl.[6] ..... G03G 21/02; G03G 21/00

[52] U.S. Cl. ..... 399/26; 399/43; 399/27

[58] Field of Search ..... 399/43, 26, 27, 399/30

[56] References Cited

U.S. PATENT DOCUMENTS 4,585,327 4/1986 Suzuki .
4,851,875 7/1989 Tanimoto .
4,873,549 10/1989 Tada et al. .
4,974,020 11/1990 Takamatsu et al. .
5,105,219 4/1992 Yoshikado .
5,353,104 10/1994 Kato et al. .
5,519,472 5/1996 Ojima et al. .

*Primary Examiner*—R. L. Moses
*Attorney, Agent, or Firm*—Fitzpatrick, Cella, Harper & Scinto

[57] ABSTRACT

An image forming apparatus includes an electrophotographic photosensitive member; a developer container for containing a developer for developing a latent image formed on the photosensitive member; measuring means for measuring usage degree of the photosensitive member; developer amount detecting means for detecting whether a remaining amount in the container is lower than a predetermined level; display means for displaying the remaining amount in accordance with the usage degree after the detecting means detects that the remaining amount is lower than the predetermined level.

8 Claims, 10 Drawing Sheets

IMAGE FORMING APPARATUS AND PROCESS CARTRIDGE FOR IMAGE FORMING APPARATUS

FIELD OF THE INVENTION AND RELATED ART

The present invention relates to an image forming apparatus such as a printer, a copying machine, or a facsimile, which employs electrophotographic technologies, and a process cartridge installable in such an image forming apparatus.

Conventionally, an image forming apparatus based on the electrophotographic image formation process employs a process cartridge system, in which an electrophotographic photosensitive member, and a processing means which acts on the electrophotographic photosensitive member, are integrated in the form of a cartridge removably installable in the main assembly of an image forming apparatus. According to this process cartridge system, an image forming apparatus does not need to be maintained by a professional service person; the user him/herself can maintain the apparatus, remarkably improving operational efficiency. As a result, the process cartridge system has come to be widely used in the field of the image forming apparatus.

Further, in the case of the image forming apparatus employing the aforementioned process cartridge system, it is very important to accurately determine the remaining service lives of the various components in a process cartridge in terms of effective utilization of natural resources. In particular, such an apparatus that can thoroughly use the developer stored in a process cartridge has been desired.

SUMMARY OF THE INVENTION

The present invention was made in view of the above problems, and its primary object is to provide an image forming apparatus and a process cartridge, which allows the developer stored in an developer storing portion to be entirely used.

Another object of the present invention is to provide an image forming apparatus and an process cartridge, which are capable of accurately determining the remaining service life of a process cartridge.

Another object of the present invention is to provide an image forming apparatus comprising a displaying means which displays the amount of the remaining developer based on the frequency of the electrophotographic photosensitive member usage, after the amount of the remaining developer drops to a predetermined level.

Another object of the present invention is to provide a process cartridge comprising a storing means for storing the information regarding the cumulative frequency of the electrophotographic photosensitive member usage, and the information regarding the frequency of the electrophotographic photosensitive member usage corresponding to the time when the amount of the remaining developer drops to a predetermined level.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferable embodiments of the present invention will be described with reference to the drawings.

(Embodiment A)

Figure 1:
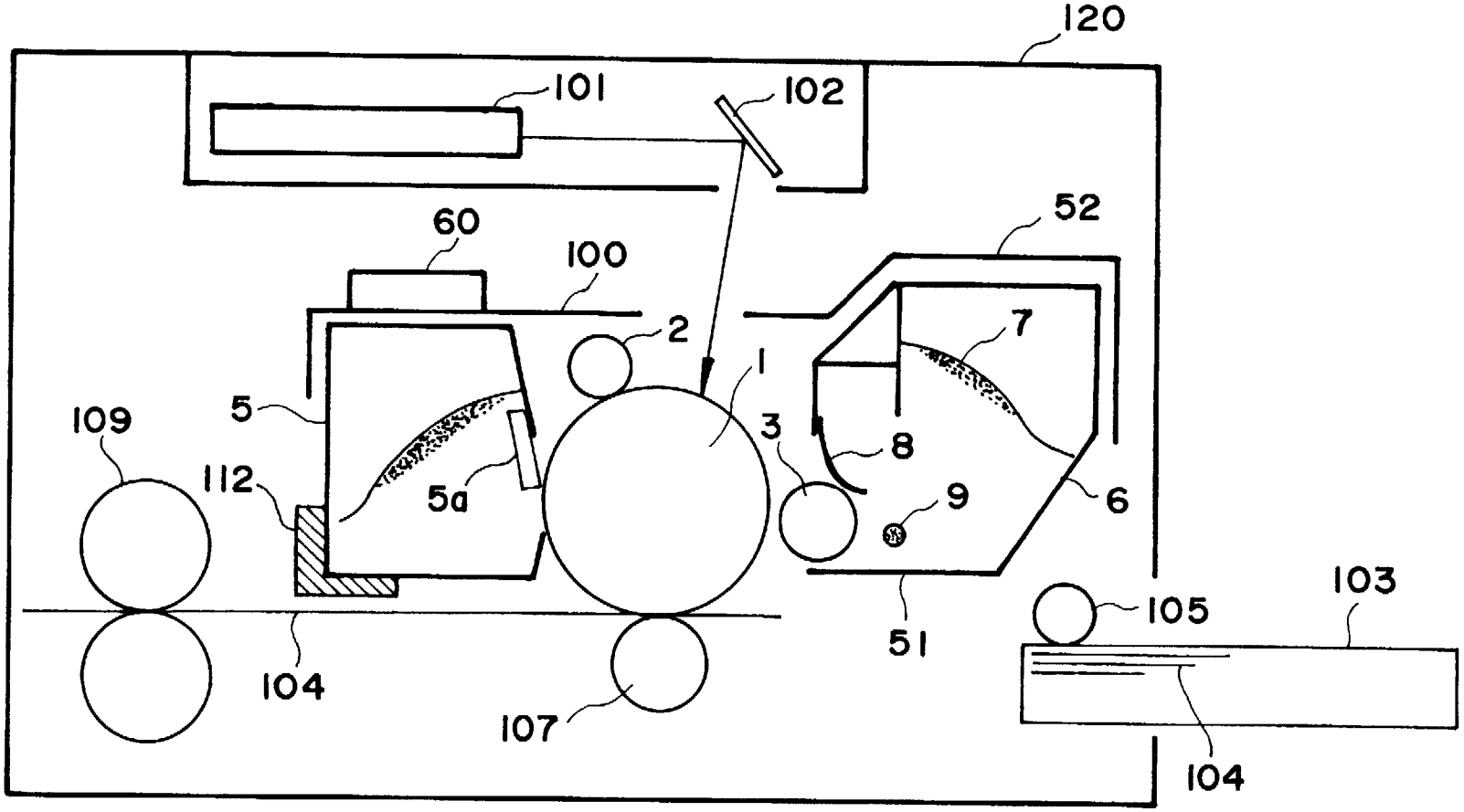
FIG. 1 is a schematic section of the image forming apparatus in an embodiment of the present invention.
Figure 2:
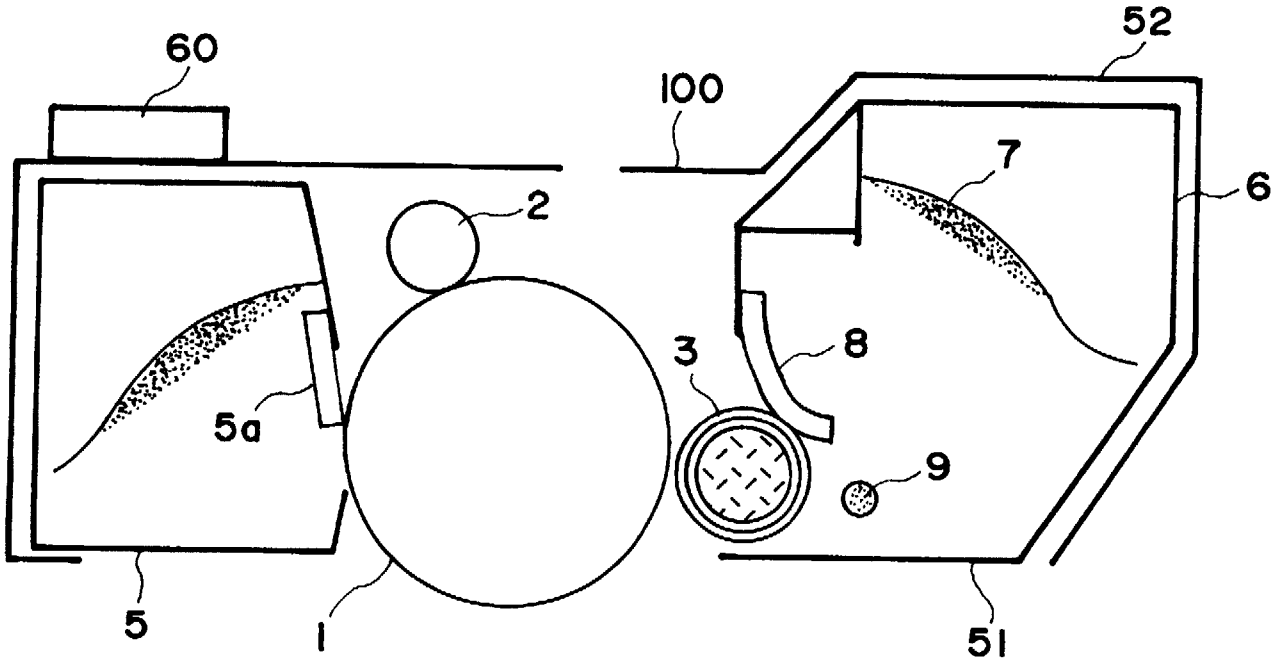
FIG. 2 is a schematic section of the process cartridge in the embodiment of the present invention.

FIG. 1 is a schematic section of an image forming apparatus comprising a process cartridge, and FIG. 2 is a schematic section of the process cartridge illustrated in FIG. 1.

First, the image forming apparatus will be described. Referring to FIG. 1, in the image forming apparatus, a laser beam modulated with imaging signals is projected from a scanner unit 101 comprising a laser, a polygon mirror correction system lens, and the like. The laser beam is reflected by a deflection mirror 102 to be projected onto a photosensitive drum 1 as an electrophotographic photosensitive member, which is uniformly charged in advance by a charging roller 2, that is, a primary charging device. As a result, an electrostatic latent image is formed on the surface of the photosensitive member 1 in response to the projected laser beam.

Meanwhile, toner 7 stored in a toner unit 6 disposed at the back side of a developing apparatus 51 is adhered to the peripheral surface of a development sleeve 3, and is conveyed. As a layer of the toner 7 is conveyed, its thickness is regulated by a development blade 8, whereby the toner 7 is triboelectrically charged by a development blade 8. As a result, a toner layer capable of developing the aforementioned electrostatic latent image is formed on the development sleeve 3. The electrostatic latent image is visualized as it is developed into a toner image by the toner layer.

Further, a recording medium 104, for example, a sheet of paper, stored in a sheet feeder cassette 103 is fed into the image forming apparatus by a sheet feeder roller 105, in synchronism with the latent image formation on the photosensitive drum 1. The recording medium 104 is conveyed to a transferring means 107 in the form of a roller, in synchronism with the leading end of the toner image on the photosensitive drum 1. Then, the toner image is transferred onto the recording medium 104 by the transferring means 107. The recording medium onto which the toner image has been transferred is conveyed to a fixing device 109, in which the toner image is fixed to the recording medium 104, becoming a permanent image. Thereafter, the recording medium 104 is discharged from the image forming apparatus.

The toner remaining on the photosensitive drum 1 is removed by a cleaning means 5, which comprises a cleaning blade 5a disposed elastically in contact with the photosensitive drum 1. A reference numeral 112 designates a means for removably installing a process cartridge. The process cartridge installing means 112 is schematically drawn.

A process cartridge 100 illustrated in FIG. 2 integrally comprises the aforementioned photosensitive drum 1, a charge roller 2, a developing apparatus 51, the cleaning means 5, and a cover 52. These components such as the photosensitive member 1 are disposed in the process cartridge 100 to give them a predetermined positional relationship. Further, the process cartridge 10 and the main assembly 120 of the image forming apparatus are designed so that the former can be inserted into, or pulled out of, a predetermined portion (installing means 112) of the latter, following predetermined steps.

The above described process cartridge 100 (hereinafter, cartridge) is replaced by the user when the toner 7 stored in the toner unit 6 is completely depleted, or when the service life of the photosensitive drum 1 expires.

The present invention is characterized in that the cartridge 100 is provided with an information storage means 60 for storing the information to be used to accurately determine the remaining service life of the cartridge 100 and inform the user about it.

As for the storage means 60 to be used with the present invention, there is no specific requirement; any storage means is acceptable as long as it is capable of rewritably storing the information in the signal form. For example, electrical storing means such as an RAM or a rewritable RAM, or a magnetic storing means such as a magnetic storing medium, a magnetic bubble memory, or a photomagnetic memory, may be employed. In this Embodiment A, nonvolatile storing means, NVRAMs, are employed in terms of ease of handling and cost, and also, because they do not require electrical backup.

Next, the remaining toner amount detecting mechanism in accordance with the present invention will be described.

There is no specific requirement regarding the remaining toner amount detecting mechanism employed in the present invention. Basically, any known mechanism may be employed as long as it is capable of detecting whether or not the amount of the remaining developer (toner 7) is no more than a predetermined value. More specifically, a mechanism employing a capacity detecting system, a mechanism employing a magnetic sensor, a mechanism that detects the weight of the toner 7, a light transmission type mechanism, or the like, may be employed.

Figure 3:
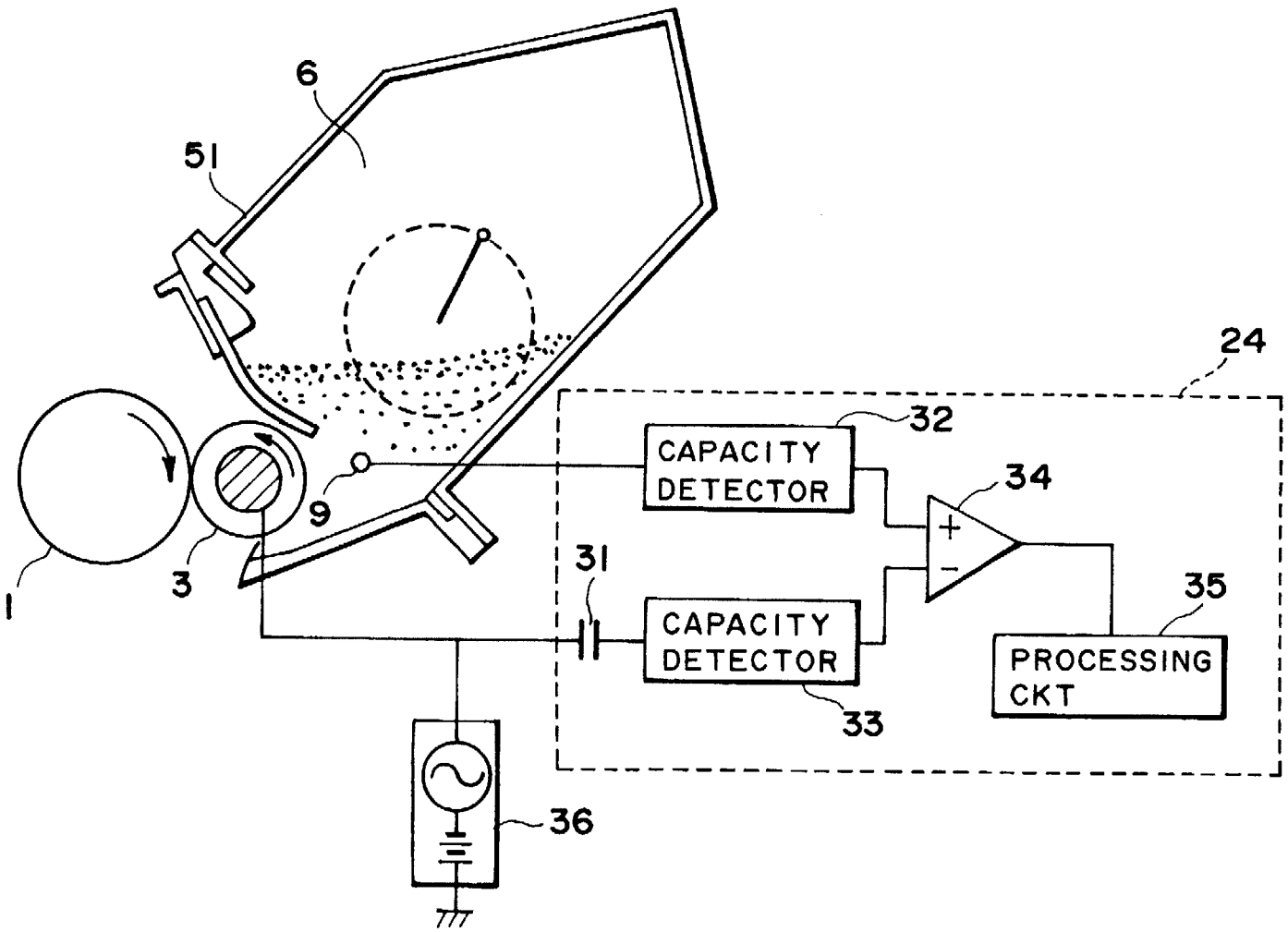
FIG. 3 is a schematic drawing depicting the mechanism for detecting the amount of the remaining developer, in the embodiment of the present invention.

Referring to FIG. 3, the remaining toner amount detecting means 24 employed in this Embodiment A comprises an electrode 9 in the form of an antenna disposed in the developing apparatus 51, a power source 36, an electrostatic capacity detecting circuit 32, an electrostatic capacity detecting circuit 33, a referential condenser 31, a comparator 34, and a processing circuit 35. The amount of the remaining toner is detected in the following manner, the electrostatic capacity between the electrode 9 and the development sleeve 3 is measured by applying an AC voltage between the electrode 9 and the development sleeve 3 as the developer carrying member. The obtained capacity is compared with the capacity of the referential condenser 31 by the comparator 34 to obtain the difference between the two capacities. The value of the difference is inputted into the processing circuit 35. When the difference becomes minus, it is determined that the amount of the remaining toner is no more than a predetermined value. In this Embodiment A, the capacity of the referential condenser is adjusted so that the difference becomes minus as the amount of the remaining toner decreases to the level which can afford printing of approximately 500 sheets in the typical printing pattern.

Next, referring to FIGS. 4 and 5, the cartridge life detecting mechanism in this Embodiment A will be described in detail.

Figure 4:
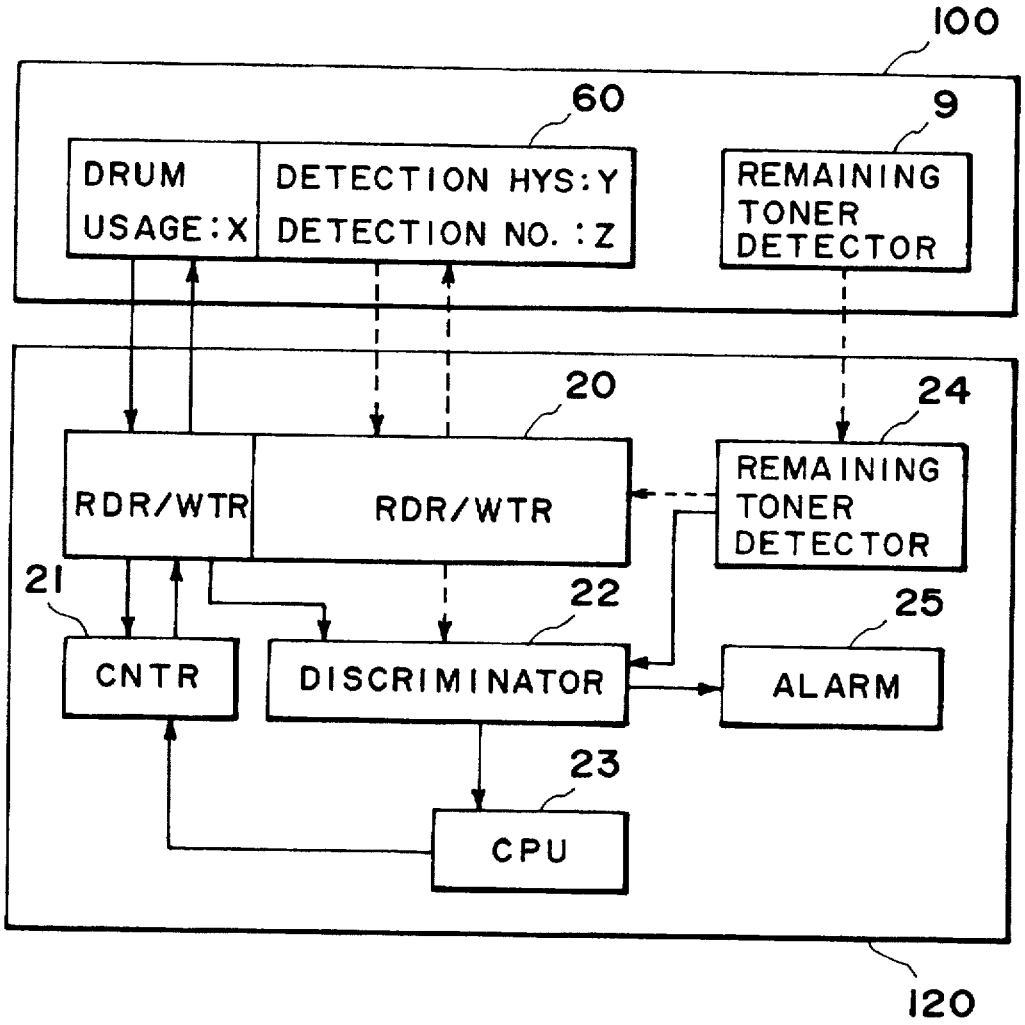
FIG. 4 is a block diagram depicting Embodiment A of the present invention.
Figure 5:
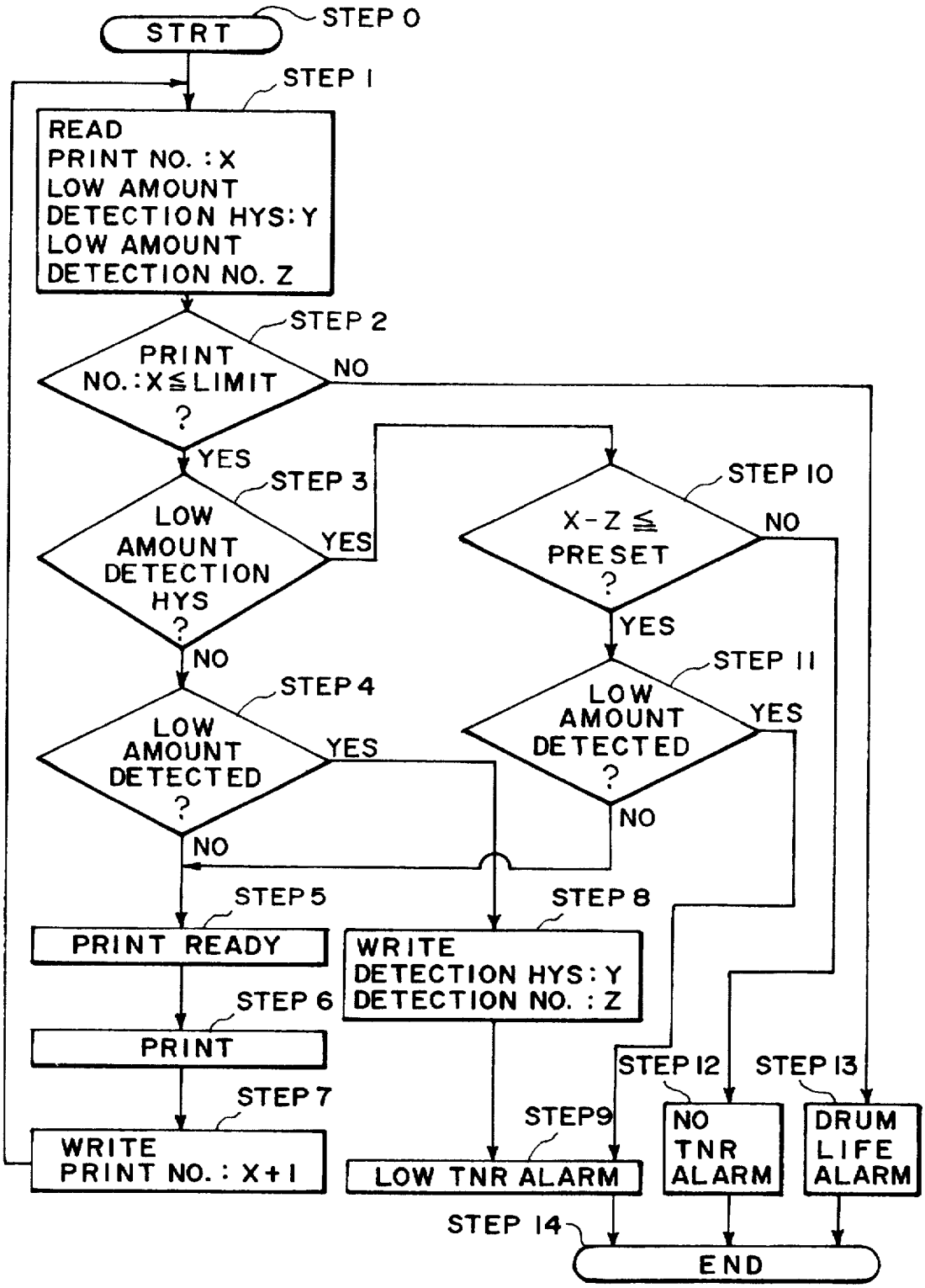
FIG. 5 is a flow chart for Embodiment A of the present invention.

FIG. 4 is a block diagram of the cartridge life detecting mechanism in Embodiment A.

In FIG. 4, a reference numeral 100 designates a cartridge and a reference numeral 120 designates the main assembly of an image forming apparatus. The NVRAM 60, which is the storing means disposed in the cartridge 100, contains the information regarding the amount X of the cumulative photosensitive drum 1 usage, the information regarding the history Y of the remaining toner amount detection, the information regarding the amount Z of the cumulative photosensitive drum usage corresponding to the time when the information regarding the history Y of the remaining toner amount detection is stored.

First, the information regarding the amount X of the cumulative photosensitive drum usage will be described. Basically, the information regarding the amount X of the cumulative photosensitive drum usage, which is to be stored in accordance with the present invention, may be in any information as long as it reflects the amount of the cumulative photosensitive drum usage for image formation. For example, the print count, or the length of time the photosensitive drum is been driven, may be used. The amount X of the cumulative photosensitive drum usage is read from the NVRAM 60 of the cartridge 100 by a reading/writing means 20 disposed on the main assembly 120 side of the image forming apparatus, and is sent to a counting means 21 and a decision making means 22 on the main assembly 120 side. The counting means 21 computes the amount of the photosensitive drum usage based on the operation signals sent from a CPU 23, and the computed amount of the photosensitive drum usage is added to the amount of the cumulative photosensitive drum usage road from the NVRAM 60. Then, the value having been stored in the storing means 60 is replaced with the thus obtained sum, by the reading/writing means 20. In other words, the information regarding the amount X of the cumulative photosensitive drum usage is renewed and stored in the storing means 60 each time an image forming operation is carried out.

Next, the information regarding the history of the remaining toner amount detection will be described. The information regarding the history of the remaining toner amount detection consists of the information regarding the detection history Y depicting whether or not it was determined in the past that the amount of the remaining toner in the cartridge 100 was no more than a predetermined value, and the information regarding the amount Z of the photosensitive drum 1 usage corresponding to the time when it was determined that the amount of the remaining toner was no more than the predetermined value. More specifically, in this Embodiment A, as the remaining toner amount detecting means 24 detects that the amount of the remaining toner is no more than a value below which the image forming apparatus cannot afford printing 500 or more sheets in the typical printing ratio, the remaining toner amount detection history Y, and the print count Z, that is, the amount of the photosensitive drum usage, corresponding to the time of the detection, are written in the storing means 60 by the reading/writing means 20. The written information Y and Z are read and sent to the decision mating means 22 by the reading/writing means 20 as the amount X of the cumulative photosensitive drum usage is.

The decision making means 22 determines the condition of the cartridge 100 based on the information regarding the amount X of the cumulative photosensitive drum usage, the information Y and Z, and the signal from the remaining toner amount detecting means 24, and sent a signal corresponding to the determine condition of the cartridge 100 to a warning displaying means 25, which displays one of multiple warnings in response to the signal from the decision making means 22.

More specifically, in this Embodiment A, the decision making means 22 selects one of the following three conditions based on the aforementioned information, and displays the warning corresponding to the selected condition, through the warning displaying means 25.

In other words, (1) When the amount X of the cumulative photosensitive usage is no less than an amount equivalent to the service life of the photosensitive drum 1 (drum life), the decision making means 22 determines that the drum life has expired, and warns the user of the drum life expiration.

(2) When the detection history Y indicating that it was detected that the amount of the remaining toner was no more than a predetermined value has been stored, the difference is detected between the print count Z indicating the drum usage amount corresponding to the time when it was detected that the amount of the remaining toner was no more than the predetermined value, and the amount X of the current cumulative photosensitive drum usage. When the detected difference is no less than a preset value, the decision making means 22 determines that the amount of the remaining toner is not sufficient for printing, and displays a toner insufficiency warning.

(3) When the apparatus condition is such that the drum life has not expired and the toner has not been completely depleted, but it is detected by the remaining toner amount detecting means 24 that the amount of the remaining toner is no more than the predetermined value, the decision making means 22 determines that the number of prints producible with the remaining toner has decreased to a critical point, and displays a warning indicating that the amount of the remaining toner is small.

Next, referring to the flow chart in FIG. 5, the steps, through which the drum life is actually detected, and the warning regarding the drum life is displayed, will be described. In the case of this flow chart, the information regarding the amount of the cumulative photosensitive drum usage is described as the cumulative print count.

First, the amount X of the cumulative photosensitive drum usage represented by the cumulative print count, the detection history Y indicating whether or not it was detected that the amount of the remaining toner was no more than the predetermined value, and the cumulative print count Z corresponding to the time of such detection, are read into the main assembly side (Step 1). This reading operation is carried out when the cartridge 100 is installed, when the power source of the main assembly 120 of the image forming apparatus is turned on, when an image forming operation is completed, or the like opportunities. Next, it is checked by the decision making means 22 whether or not the read print count X is no more than a value equivalent to the preset drum life of the cartridge 100 (Step 2). When the print count X is larger than the value equivalent to the drum life, a drum life warning is displayed by the warning displaying means 25, prompting the user to replace the cartridge (Step 13).

When the count X is no more than the value equivalent to the drum life, it is checked by the decision making means 22 whether or not the detection history Y indicating that the amount of the remaining toner was once no more than the predetermined value has been stored (Step 3). When it is determined in Step 3 that the detection history Y has been stored, the difference is detected between the current print count X, and the print count Z corresponding to the time when it was determined that the amount of the remaining toner was no more than the predetermined value, and the detected difference is compared with the preset value (Step 10). When the detected difference is no less than a preset value, the decision making means 22 determines that the amount of the remaining toner is insufficient for printing, and displays the toner insufficiency warning to prompt the user to replace the cartridge 100 (Step 12).

When it is determined in Step 10 that the difference between the print count X and the print count Z is no more than a preset count, it is checked whether or not it has been detected by the remaining toner amount detecting means 24 that the amount of the remaining toner is no more than the predetermined value (Step 11). When it has not been detected, Step 5 is taken, in which the apparatus is readied for printing, but when it has been detected that the amount of the remaining toner is no more than the predetermined value, the decision making means 22 determines that the number of prints producible with the remaining toner has become smaller, and warns the user that the amount of the remaining toner is small (Step 9).

When it is determined in Step 3 that the detection history Y has not been stored, it is checked whether or not it has been detected by the remaining toner amount detecting means 24 that the remaining toner amount is no more than the predetermined value. When it has not been detected, Step 5 is taken, in which the apparatus is readied for printing, but when it has been detected that the remaining toner amount is no more than the predetermined value, the detection history Y and the corresponding print count Z are written in the storing means 60 (Step 8), and the decision making means 22 determines that the number of prints producible with the remaining toner has become smaller, and warns the user that the amount of the remaining toner is small (Step 9).

After the apparatus is readied for printing (Step 5), a print is produced (step 6). Then, a value (X+1) is written in the storing means (Step 7), and the operation goes back to Step 1.

With the employment of the above described drum life detection mechanism, the condition of the cartridge 100 can be determined based on both the service life of the photosensitive drum 1 and the amount of the remaining toner; therefore, it becomes possible to accurately detect the remaining service life of the cartridge 100.

Further, since the condition of the cartridge 100 is determined based on the information stored in the storing means provided in the cartridge 100, the remaining service life of each cartridge 100 can be accurately detected even when a plurality of cartridge 100 are used with a single image forming apparatus.

In Embodiment A, the means for displaying the drum life warning, the toner insufficiency warning, and the small toner amount warning, is optional. For example, the LEDs for the warning display may be turned on and off with different intervals, may be changed in color, or may be turned on and off in different patterns so that the information displayed on the display window can be varied.

(Embodiment B)

Next, referring to FIGS. 6 and 7, Embodiment B of the present invention will be described.

Figure 6:
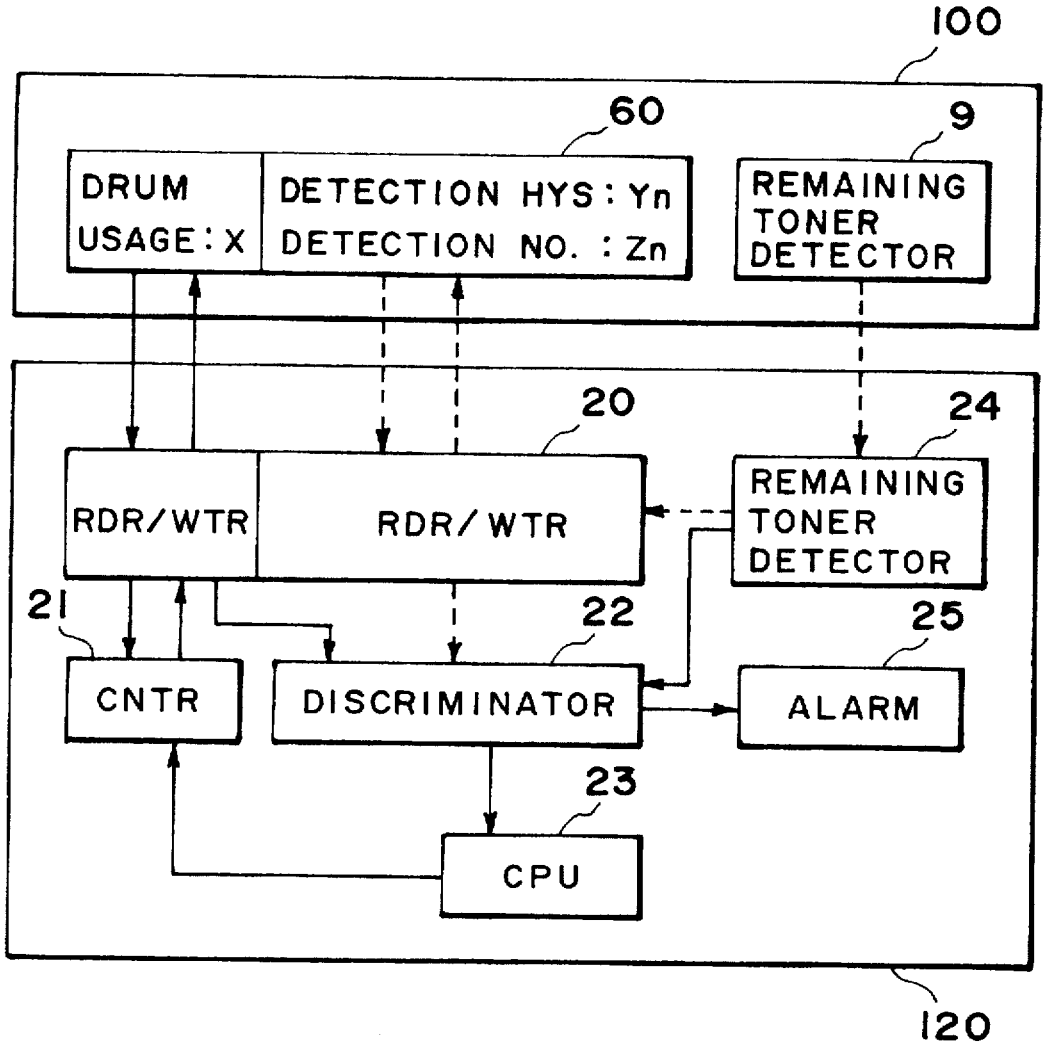
FIG. 6 is a block diagram depicting Embodiment B of the present invention.

FIG. 6 is a block diagram of the drum life detection mechanism in this embodiment. Embodiment B is characterized in that a plurality of the detection histories Y indicating that the detected amount of the remaining toner was no more than the predetermined value, and a plurality of the corresponding print counts Z, are stored in the storing means 60. In other words, detection histories Y1, Y2 and so on are stored in the order of detection, and corresponding print counts Z1, Z2 and so on are stored in the same manner. In this embodiment, these information are expressed as Yn and Zn.

Generally speaking, even after it is detected by the remaining toner amount detecting means 24 that the amount of the remaining toner is no more than the predetermined value, the actual amount of the remaining toner contributible to development can be increased by taking the cartridge 100 out of the image forming apparatus and shaking it, for example. This is because the toner adhering to the internal wall surface, or the like, of the toner unit 6, or the unevenly distributed toner in the developing apparatus 51, is loosened or redistributed, adding to the amount of the usable toner. When this cartridge 100 is reinstalled, it is sometimes detected that the amount of the remaining toner has "recovered", that is, the amount of the remaining toner is no less than the predetermined value. In such a case, as the toner is further consumed through printing, it is detected the second time that the amount of the remaining toner has dropped below the predetermined value.

Embodiment B is characterized in that the remaining service life of the cartridge 100 can more accurately detected when a plurality of the detection histories Indicating that the amount of the remaining toner is no more than the predetermined value are Stored as described in the foregoing paragraph.

Regarding FIG. 6, the functions of various means will not be described since they are the same as those described in Embodiment A. In Embodiment B, the decision making means 22 selects one out of the following four conditions of the cartridge 100, based on the plurality of the remaining toner amount detection histories, and displays a warning corresponding to the selection, through the warning displaying means 25.

In other words, (1) When the amount X of the cumulative photosensitive drum usage is no less than a predetermined amount equivalent to the service life of the photosensitive drum 1, the decision making means 22 determines that the drum life has expired, and warns the user of the drum life expiration.

(2) When information regarding the detection history indicating that the amount of the remaining toner had dropped below the predetermined value has been stored once or more, the difference is detected between the amount Z of the cumulative photosensitive drum usage (cumulative print count) corresponding to the first time it was detected that the amount of the remaining toner was no more than the predetermined value, and the amount X of the current cumulative photosensitive drum usage. When the detected difference is no less than a preset value, the decision making means 22 determines that the amount of the remaining toner is insufficient for printing, and warns the user of toner insufficiency.

(3) When information regarding the detection history indicating that the amount of the remaining toner had dropped below the predetermined value has been stored once or more, and then, it is detected that the amount of the remaining toner has fallen again below the predetermined value after the amount of the usable toner had been recovered by shaking the cartridge 100 or the like means, the difference is detected between the print count Zn corresponding to the last time it was detected that the amount of the remaining toner was no more than the predetermined value, and a print count $Z_{n+1}$ corresponding to this time it is detected that the amount of the remaining toner is no more than the predetermined value. When the detected difference is no more than the preset count, the decision making means 22 determines that the amount of the remaining toner is insufficient for further printing, and warn the user of toner insufficiency.

(4) When it is detected by the remaining toner amount detecting means that the amount of the remaining toner has fallen below the predetermined value, under the condition that the drum life has not expired, and the toner has not been completely depleted, the decision making means 22 determines that the number of the prints producible with the remaining toner has become smaller, and warns the user that the amount of the remaining toner is small.

Next, referring to the flow chart in FIG. 7, consisting of FIGS. 7A and 7B, the steps in Embodiment B, through which the actual service life of the cassette 100 is detected, and the corresponding warning is displayed, will be described. Also in this flow chart, the information regarding the amount of the cumulative photosensitive drum usage is described as the cumulative print count.

First, the print count X and the toner amount detection history Yn, and the corresponding print count Zn, are read from the storing means of the cartridge 100 as they are in Embodiment A (Step 21). Then, it is checked whether or not the read cumulative print count X is no more than the print count equivalent to the drum life (Step 22). When the print count X is no less than the print count equivalent to the drum life, a drum life warning is displayed by the warning displaying means 25 (Step 38).

When the print count X is no more than the drum life equivalent count, it is checked by the decision making means 22 whether or not the detection history Yn has been stored (Step 23). When it has not been stored, it is checked whether or not it has been detected by the remaining toner amount detecting means 24 that the amount of the remaining toner is no more than the predetermined value (Step 24). When it has not been detected that the amount of the remaining toner is no more than the predetermined value, the apparatus is readied for printing (Step 25), and a printing operation is carried out (Step 26). Then, a value (X+1) as the print count is written in the storing means, and the operation flows back to Step 21 (Step 27). However, when it is determined in Step 24 that it has been detected that the amount of the remaining toner is no more than the predetermined value, this detection is the first detection. Therefore, a detection history Y1 and a corresponding print count 21 ar written in the storing means 60 (Step 28). Then, the decision making means 22 determines that the number of prints producible with the remaining toner has become smaller, and warns the user that the amount of the remaining toner is small (Step 36).

When it is determined in Step 23 that the decision history Yn has been stored, difference is checked between the print count X, and the print count Z1 corresponding to the first detection (Step 29). When the difference between X and Z1 is larger than a preset count, the decision making means 22 determines that the amount of the remaining toner is insufficient for printing, and warns the user of toner insufficiency (Step 37).

When it is determined in Step 29 that the difference between X and Z1 is smaller than the predetermined count, it is checked whether or not it has been detected that the amount of the remaining toner Is no more than the predetermined value (Step 30). When it has not been detected, the operation advances to Step 31, in which the apparatus is readied for printing, but when it has been detected that the amount of the remaining toner is no more than the predetermined value, the decision making means 22 determines that the number of the prints producible with the remaining toner has become smaller, and warns the user that the amount of the remaining toner is small (Step 37).

The steps described In the foregoing paragraph are basically the same as those described in Embodiment A.

Next, what characterized Embodiment B will be described. It is checked whether or not it has been detected by the remaining toner amount detecting means 24 that the amount of the remaining toner is no more than the predetermined value (Step 30). When it has not been detected, the apparatus is readied for printing (Step 31), and a print is produced (Step 32). Thereafter, it is checked again whether or not the amount of the remaining toner has dropped to the predetermined value or below (Step 33). When it is not detected that the amount of the remaining toner is no more than the predetermined value, the operation goes to Step 27, and returns to Step 21. But, when it is detected, a detection history $Y_{n+1}$ and a corresponding print count $Z_{n+1}$ are freshly written in the storing means 60 (Step 34). When it is detected in Step 33 that the amount of the remaining toner of a cartridge is no more than the predetermined value, it is possible to think that this cartridge is such a cartridge that had been shaken, or subjected to the like actions, in order to increase the usable amount of the remaining toner after it had been once detected that the amount of the remaining toner therein was no more than the predetermined value, and that the amount of the remaining toner in this cartridge is found to be no more than the predetermined value for the second time.

Next, the difference between the newly stored print count $Z_{n+1}$ and the print count Zn stored the last time is checked in Step 35. When the difference between $Z_{n+1}$ and Zn is no more than 10, for example, the decision making means 22 determines that printing becomes impossible immediately even after the cartridge 100 is shaken, and displays the toner insufficiency warning to prompt the user to replace the cartridge 100 (Step 37). When the difference between $Z_{n+1}$ and Zn is no less than 10, for example, the decision making means 22 determines that the cartridge 100 is still usable for printing, and warns the user that the amount of the remaining toner is small (Step 36).

In this Embodiment B, when it is detected a plurality of times for the same cartridge that the amount of the remaining toner is no more than the predetermined value, each occurrence is stored as an independent toner amount detection history Y. Therefore, it is possible to accurately detect even the remaining service life of a cartridge 100 which had been shaken to increase the amount of the remaining usable toner.

This Embodiment B is characterized in that the remaining service life of the cartridge 100 is detected by storing a plurality of information regarding the remaining toner amount detection history. The toner amount detection routine in this embodiment can be applied to other methods; for example, a method for displaying a warning which indicates insufficiency in the amount of the remaining toner in the cartridge 100 immediately after it is detected a given number of times for the same cartridge that the amount of the remaining toner is no more than the predetermined value.

(Embodiment C)

Next, referring to FIGS. 6 and 9, Embodiment C of the present invention will be described.

Figure 8:
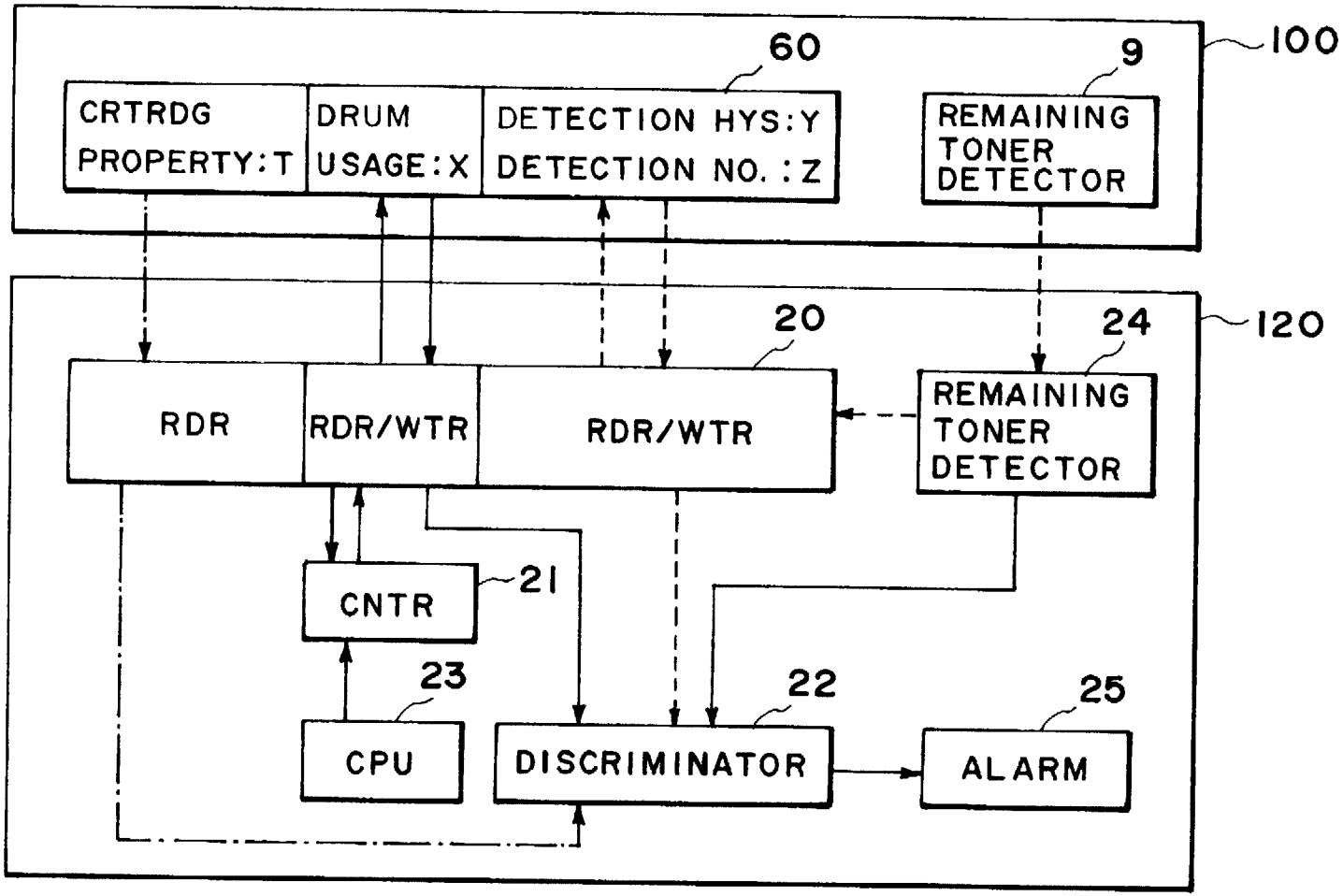
FIG. 8 is a block diagram depicting Embodiment C of the present invention.

FIG. 8 is a block diagram of the cartridge service life detection mechanism in Embodiment C. This embodiment is characterized in that the information to be stored in the storing means 60 comprises the information regarding the characteristic T of the cartridge 100. Recently, user's demands have been diversifying, and with this trend, various cartridges suitable for different jobs have been developed. They are installable in the main assembly of the same image forming apparatus. For example, a large capacity cartridge and a small capacity cartridge have been put to practical use for the user who produces a large number of prints, and the user who produces only a small number of prints, respectively. Sometimes, the service lives of the photosensitive drum in these cartridges are rendered different, that is, they are rendered proportional to the cartridge capacity. In this Embodiment C, the component characteristic which varies from one type of the cartridge to the other type of the cartridge is stored as the component characteristic information so that even when a plurality of cartridges of different types are employed, the remaining service live of each cartridge can be accurately detected.

Referring to FIG. 8, the information regarding the cartridge characteristic T read by the reading/writing means 20 is sent to the decision making means 22. The decision making means 22 modifies the reference used for detecting the remaining service life, based on the information regarding the cartridge characteristic T. For example, when the information regarding the cartridge characteristic T is an information regarding the drum life, the reference for detecting the remaining drum life is modified in response to the information regarding the cartridge characteristic T. The functions of the other means in FIG. 8 are the same as those described in Embodiment A, and therefore, their description will be omitted.

Next, referring to the flow chart in FIG. 9, the steps in Embodiment C, through which the actual remaining service life of a cartridge is detected, and a corresponding warning is displayed, will be described. In this flow chart, the information regarding the amount of the cumulative photosensitive drum usage is described as the print count, and the information regarding the cartridge characteristic is described as the characteristic related to the drum life.

First, the information regarding the cartridge characteristic T, the print count X, the amount detection history Y indicating that the amount of the remaining toner became less than the predetermined value, and the print count Z corresponding to the toner amount detection history Y, are read from the storing means of the cartridge 100 (Step 41). This reading operation is carried out when the cartridge 100 is installed, when the electric power source of the main assembly 120 of an image forming apparatus is turned on, and when an image forming operation is completed. Next, a print count M equivalent to the service life of the photosensitive drum 1 of the installed cartridge 100 is computed by the decision making means 22 based on the read information regarding the cartridge characteristic T (Step 42).

The print count X read after the print count M equivalent to the service life of the photosensitive drum is computed is compared with the print count M equivalent to the service life of the photosensitive drum (Step 43). When the print count X is larger than the service life print count M, a drum life warning is displayed by the warning displaying means 25 to prompt the user to replace the cartridge 100 (Step 54).

Figure 9:
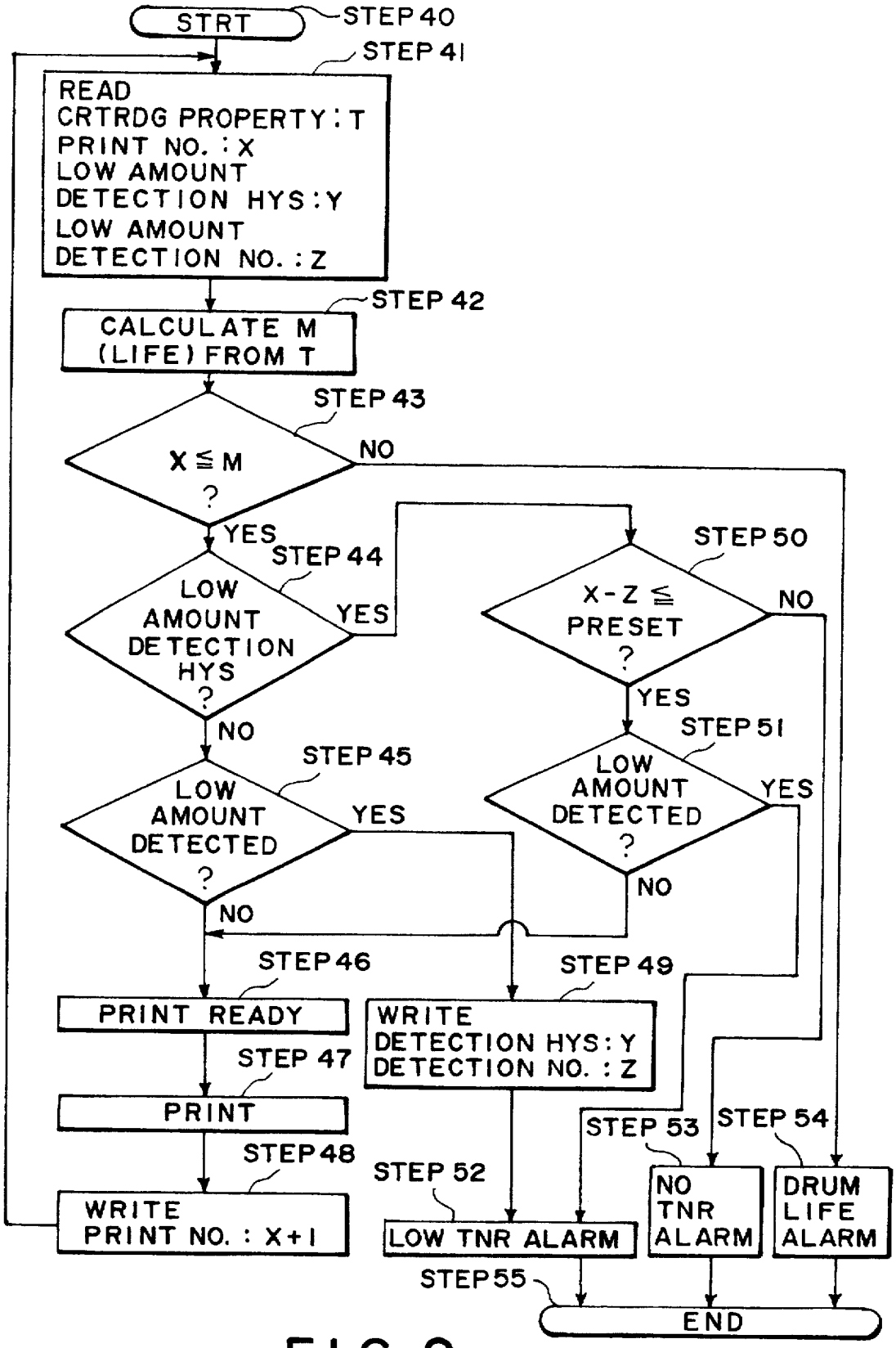
FIG. 9 is a flow chart for Embodiment C of the present invention.

Referring to FIG. 9, the service life detection routine after the Step 43 is the same as the one described in Embodiment A, an therefore, the description given in Embodiment A may be quoted.

In this Embodiment C, the information regarding the characteristics of the components constituting the cartridge 100 is stored in the storing means 60. Therefore, it becomes possible to accurately detect the remaining service life of a cartridge regardless of cartridge type.

The information regarding the cartridge characteristic, which is described in this Embodiment C, is not restricted in a specific manner. In addition to the aforementioned information regarding the service life of the photosensitive drum 100, information regarding developer type which changes the amount of developer consumption may be employed. In other words, any type of information is usable as long as it is related to a characteristic peculiar to a given cartridge.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an electrophotographic photosensitive member;

a developer container for containing a developer for developing a latent image formed on said photosensitive member;

measuring means for measuring a usage degree of said photosensitive member;

developer amount detecting means for detecting whether a remaining amount of the developer in said container is lower than a predetermined level;

display means for displaying the remaining amount of the developer in accordance with the usage degree of the photosensitive member after said detecting means detects that the remaining amount of the developer is lower than the predetermined level.

2. An apparatus according to claim 1, wherein after said detecting means detects that the remaining amount of the developer is lower than the predetermined level, said display means displays a no toner condition when the usage degree of the photosensitive member reaches a predetermined degree of usage, and said display a means displays shortage of toner when the degree of usage has not yet reached the predetermined degree of usage.

3. An apparatus according to claim 1, further comprising developing means for developing the latent image, wherein said photosensitive member and said developing means are unified into a cartridge which is detachably mountable to a main assembly of said image forming apparatus.

4. A process cartridge detachably mountable to a main assembly of an image forming apparatus, comprising:

an electrophotographic photosensitive member;

a developer container for containing a developer for developing a latent image formed on said photosensitive member;

storing means for storing information indicative of an integrated degree of usage relating to wear of said photosensitive member, and information indicative of a degree relating to wearing of said photosensitive member when a remaining amount of the developer in said container reaches a predetermined level.

5. A process cartridge according to claim 4, wherein said storing means stores information indicative of whether the remaining amount of the developer has reached the predetermined level.

6. A process cartridge according to claim 4, wherein said storing means includes a semiconductor memory.

7. A process cartridge according to claim 4, wherein the information indicative of degree relating to wearing of said photosensitive member is represented by a number of prints.

8. A process cartridge according to claim 4, wherein the information indicative of degree relating to wearing of said photosensitive member is represented by a driving period of said photosensitive member.

* * * * *

UNITED STATES PATENT AND TRADEMARK OFFICE

CERTIFICATE OF CORRECTION

PATENT NO. : 5,802,419

DATED : September 1, 1998

INVENTORS : KAZUSHIGE SAKURAI, ET AL.

It is certified that error appears in the above-identified patent and that said Letters Patent is hereby corrected as shown below:

COLUMN 1,
Line 38, "an" should read --a--; and
Line 41, "an" should read --a--.

Figures 7, 7A:
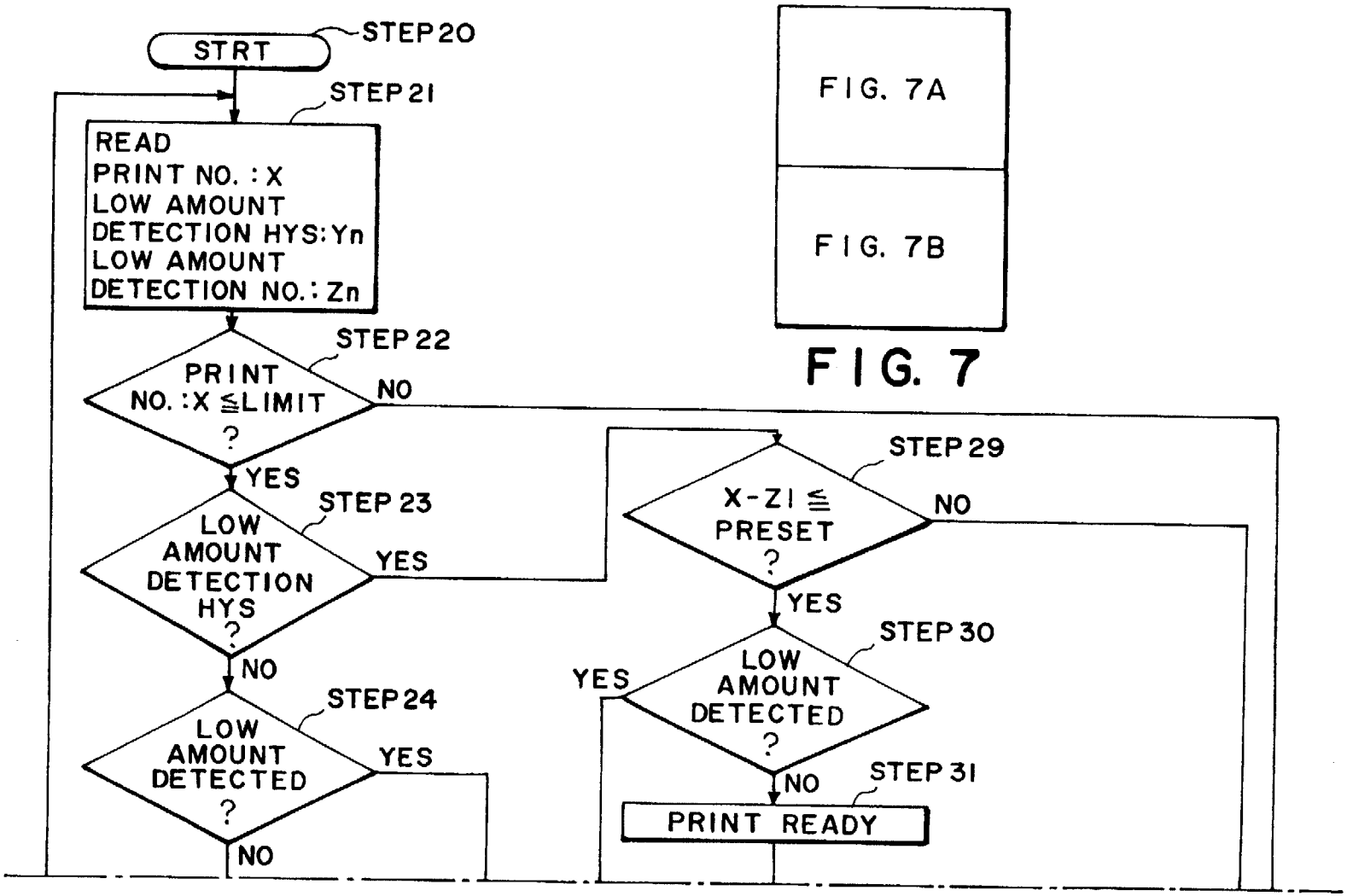
FIG. 7 consisting of FIGS. 7A and 7B, is a flow chart for Embodiment B of the present invention.
Figure 7B:
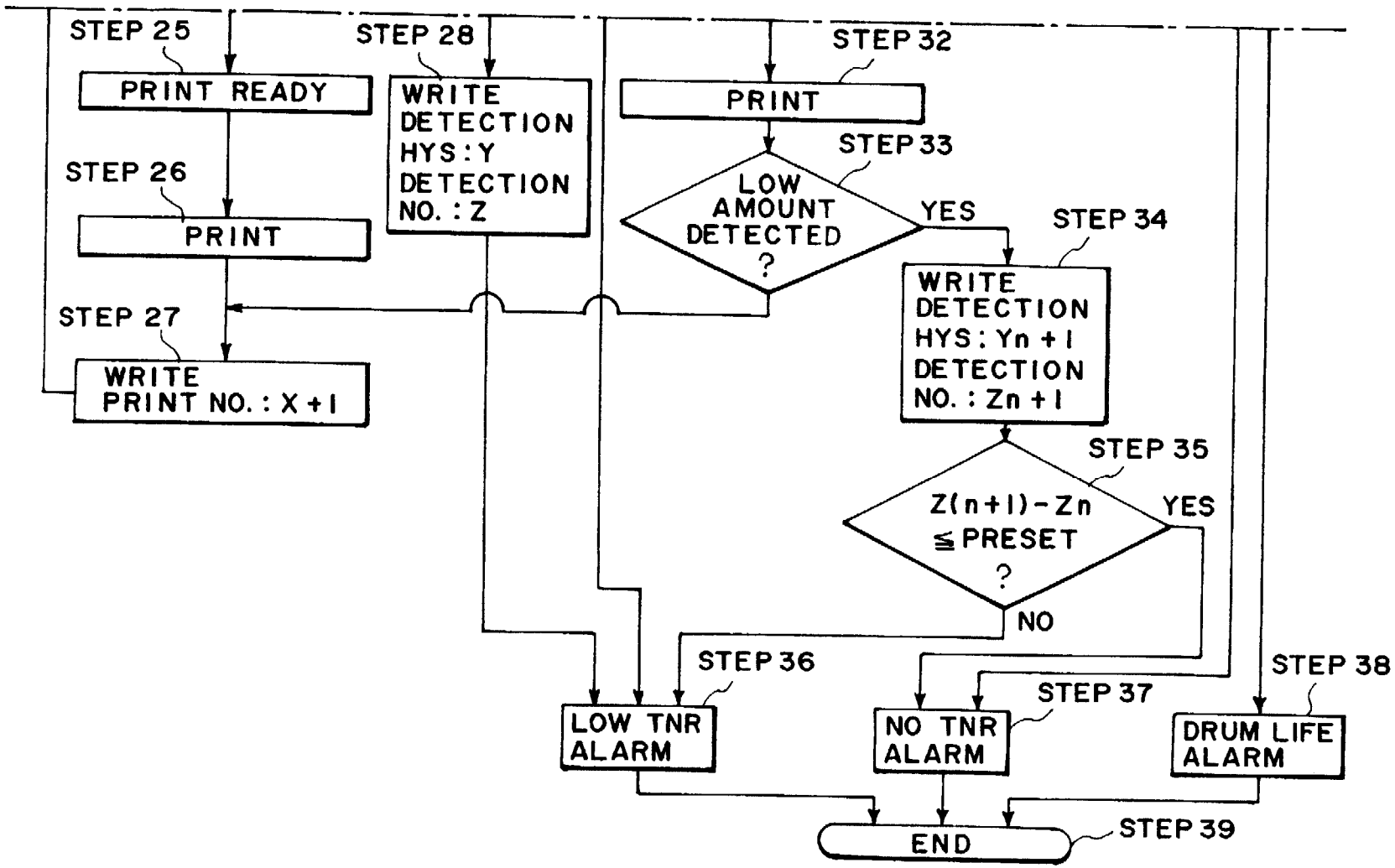

COLUMN 2,
Line 12, "Fig. 7" should read --Fig. 7,--.

COLUMN 3,
Line 11, "10" should read --100--.

COLUMN 4,
Line 63, "mating" should read --making--.

COLUMN 5,
Line 3, "sent" should read --sends--; and
Line 4, "determine" should read --determined--.

COLUMN 7,
Line 7, "these" should read --this--; and "are" should read --is--;
Line 27, "accurately" should read --accurately be--;
Line 28, "Indicating" should read --indicating--; and
Line 30, "Stored" should read --stored--.

UNITED STATES PATENT AND TRADEMARK OFFICE

CERTIFICATE OF CORRECTION

PATENT NO. : 5,802,419

DATED : September 1, 1998

INVENTORS : KAZUSHIGE SAKURAI, ET AL.

It is certified that error appears in the above-identified patent and that said Letters Patent is hereby corrected as shown below:

COLUMN 8,
Line 11, "warn" should read --warns--; and
Line 55, "ar" should read --are--.

COLUMN 9,
Line 4, "Is" should read --is--.

COLUMN 10,
Line 22, "live" should read --life--; and
Line 66, "an" should read --and--.

Signed and Sealed this

Thirteenth Day of April, 1999

*Attest:*

Q. TODD DICKINSON

*Attesting Officer*

*Acting Commissioner of Patents and Trademarks*